US012078374B2

(12) United States Patent
Brahme

(10) Patent No.: US 12,078,374 B2
(45) Date of Patent: Sep. 3, 2024

(54) HVAC SYSTEM WITH IMPROVED OPERATION OF A SINGLE-STAGE COMPRESSOR DURING A PEAK DEMAND RESPONSE

(71) Applicant: Lennox Industries Inc., Richardson, TX (US)

(72) Inventor: Rohini Brahme, Irving, TX (US)

(73) Assignee: Lennox Industries Inc., Richardson, TX (US)

( * ) Notice: Subject to any disclaimer, the term of this patent is extended or adjusted under 35 U.S.C. 154(b) by 254 days.

(21) Appl. No.: 17/654,342

(22) Filed: Mar. 10, 2022

(65) Prior Publication Data

US 2023/0288092 A1 Sep. 14, 2023

(51) Int. Cl.
*F24F 11/65* (2018.01)

(52) U.S. Cl.
CPC ..... *F24F 11/65* (2018.01)

(58) Field of Classification Search
CPC .. F24F 11/65; F24F 11/64; F24F 11/61; F24F 11/62; F24F 11/86; F24F 11/46; F24F 2110/10; F24F 2120/10; F24F 2140/50; F24F 2140/60
See application file for complete search history.

(56) References Cited

U.S. PATENT DOCUMENTS

| | | | | |
|---|---|---|---|---|
| 11,861,634 | B2 * | 1/2024 | Matsuoka | G06Q 50/06 |
| 2014/0277795 | A1 * | 9/2014 | Matsuoka | G06Q 50/06 700/291 |
| 2015/0276253 | A1 * | 10/2015 | Montalvo | H04L 12/2827 700/276 |
| 2017/0343228 | A1 * | 11/2017 | Dyess | F24F 11/64 |
| 2018/0066860 | A1 * | 3/2018 | Carlson | F24F 11/77 |
| 2020/0003441 | A1 * | 1/2020 | Brahme | G05D 23/1917 |
| 2020/0116382 | A1 * | 4/2020 | Yang | F24F 11/63 |
| 2020/0141603 | A1 * | 5/2020 | Brahme | F24F 11/46 |
| 2021/0046800 | A1 * | 2/2021 | Goel | B60H 1/00735 |
| 2021/0048211 | A1 * | 2/2021 | Goel | F24F 11/74 |
| 2021/0048212 | A1 * | 2/2021 | Goel | F24F 13/30 |
| 2021/0359516 | A1 * | 11/2021 | Hatamosa | G06Q 10/06312 |

* cited by examiner

*Primary Examiner* — Nelson J Nieves
(74) *Attorney, Agent, or Firm* — Baker Botts L.L.P.

(57) ABSTRACT

An HVAC system is configured to regulate a temperature of a space. The HVAC system includes a single-stage compressor configured to compress a refrigerant used to cool air provided to the space and a controller communicatively coupled to the single-stage compressor. The controller determines that a demand response time period is starting at a start time. After determining that the demand response time period is starting at the start time, an operation schedule is determined indicating alternating portions of the demand response period during which the single-stage compressor is to be turned off and turned on. At or after the start time of the demand response time period, the controller begins operating the single-stage compressor according to the determined operation schedule.

20 Claims, 4 Drawing Sheets

HVAC SYSTEM WITH IMPROVED OPERATION OF A SINGLE-STAGE COMPRESSOR DURING A PEAK DEMAND RESPONSE

TECHNICAL FIELD

This disclosure relates generally to heating, ventilation, and air conditioning (HVAC) systems. More particularly, in certain embodiments, this disclosure relates to an HVAC system with improved operation of a single-stage compressor during a peak demand response.

BACKGROUND

Heating, ventilation, and air conditioning (HVAC) systems are used to regulate environmental conditions within an enclosed space. Air is cooled via heat transfer with refrigerant flowing through the HVAC system and returned to the enclosed space as conditioned air.

SUMMARY OF THE DISCLOSURE

In some cases, HVAC systems may be required to operate under restricted operating requirements to reduce power consumption during times of peak electricity demand and/or decreased electricity supply, referred to in this disclosure as peak demand response times or demand response times. For example, a third party such as a utility provider may enforce certain operating restrictions upon HVAC systems during peak demand response times. A peak demand response time may correspond, for example, to a time period associated with high outdoor temperatures or any other time when electrical power consumption is expected (e.g., based on a forecast or projection) to be increased. Generally, the third party (e.g., a utility provider) provides a request, referred to herein as a demand response, which specifies an upper limit on power consumption by an HVAC system during a peak demand response time.

The system of this disclosure solves problems of previous HVAC systems by facilitating improved comfort during peak demand response times by intelligently operating (e.g., turning on and off on a specially determined schedule) a single-stage compressor of an HVAC system more efficiently and effectively than was previously possible. For example, when a demand response is upcoming, a controller of the HVAC system may determine an efficient operation schedule of on and off times for the compressor that improves user comfort during a demand response time while also meeting energy saving requirements. In certain embodiments, the systems and methods described in this disclosure may be integrated into a practical application of an HVAC controller that improves system performance and occupant comfort during peak demand response times by more effectively and efficiently operating the compressor. In certain embodiments, an operation schedule is determined by predicting indoor air temperatures for different possible operation schedules and selecting the operation schedule that most improves occupant comfort while also saving energy (e.g., by meeting comfort and/or energy-saving criteria).

Certain embodiments may include none, some, or all of the above technical advantages. One or more other technical advantages may be readily apparent to one skilled in the art from the figures, descriptions, and claims included herein.

In an embodiment, an HVAC system is configured to regulate a temperature of a space. The HVAC system includes a single-stage compressor configured to compress a refrigerant used to cool air provided to the space and a controller communicatively coupled to the single-stage compressor. The controller determines that a demand response time period is starting at a start time. The demand response time period is a future period of time during which a reduction in energy consumption by the HVAC system is requested. After determining that the demand response time period is starting at the start time, an operation schedule is determined indicating alternating portions of the demand response period during which the single-stage compressor is to be turned off and turned on. At or after the start time of the demand response time period, the controller begins operating the single-stage compressor according to the determined operation schedule.

BRIEF DESCRIPTION OF THE DRAWINGS

For a more complete understanding of the present disclosure, reference is now made to the following description, taken in conjunction with the accompanying drawings, in which.

DETAILED DESCRIPTION

Embodiments of the present disclosure and its advantages are best understood by referring to FIGS. 1 through 4 of the drawings, like numerals being used for like and corresponding parts of the various drawings.

As described above, prior to the present disclosure, there was a lack of tools for improving comfort in a conditioned space in response to a demand response (i.e., a request for decreased HVAC energy consumption). This disclosure recognizes that temperature in a space (e.g., a home, office, or other building) that is serviced by an HVAC system with a single-stage compressor can be maintained at more comfortable levels than was formerly achieved by more efficiently and effectively staging the operations of the compressor. In this way, effective cooling is still provided during the peak demand response time, while still satisfying the energy-saving requirements of the demand response. Turning off a compressor corresponds to stopping or preventing operation of the compressor of the HVAC system, such that the HVAC system does not provide cooling to a corresponding space and such that the energy consumption of the HVAC system is negligible. Likewise, turning on a compressor corresponds to starting or allowing operation of the compressor, such that the HVAC system can provide cooling to the space. For example, when a compressor is turned on, the HVAC system may provide cooling based on a predefined setpoint temperature.

HVAC System

Figure 1:
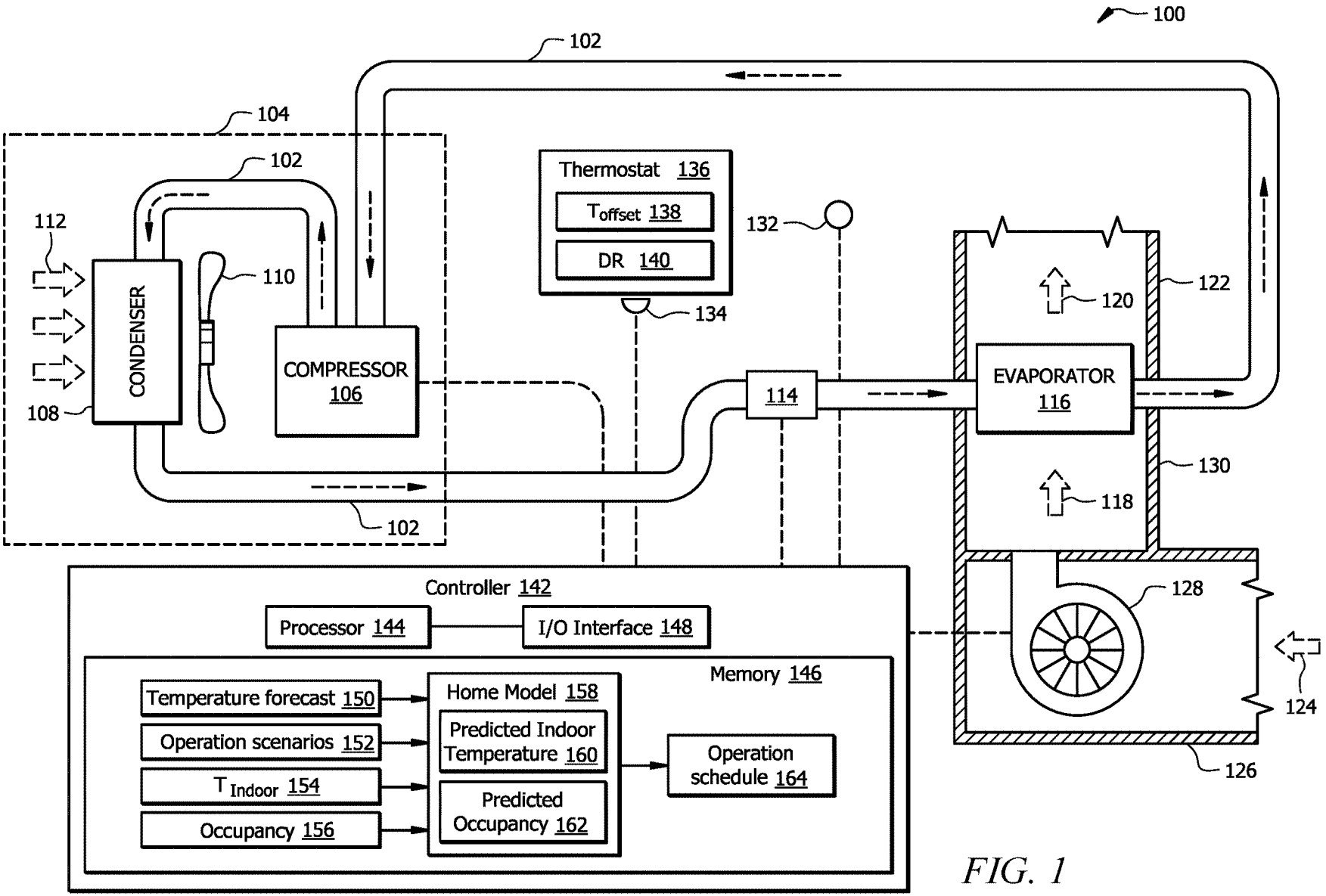
FIG. 1 is a diagram of an example HVAC system configured for improved operation during peak demand response times.

FIG. 1 shows an example HVAC system 100 configured to operate according to a specially determined operation schedule 164 in response to a demand response 140 (abbreviated as "DR" in FIG. 1). A controller 142 of the HVAC system 100 may determine the operation schedule 164, which indicates times during which the compressor 106 is turned off and on during a demand response time, such that user comfort can be maintained while still achieving the decrease in energy consumption indicated by the demand response 140. A demand response 140 generally indicates an upper limit on power consumption by the HVAC system 100 during a future period of time (e.g., demand response time 204 of FIG. 2).

The HVAC system 100 conditions air for delivery to a conditioned space (e.g., all or a portion of a room, a house, an office building, a warehouse, or the like). In some embodiments, the HVAC system 100 is a rooftop unit (RTU) that is positioned on the roof of a building and the conditioned air is delivered to the interior of the building. In other embodiments, portion(s) of the system 100 may be located within the building and portion(s) outside the building. The HVAC system 100 may include one or more heating elements, not shown for convenience and clarity. The HVAC system 100 may be configured as shown in FIG. 1 or in any other suitable configuration. For example, the HVAC system 100 may include additional components or may omit one or more components shown in FIG. 1.

The HVAC system 100 includes a working-fluid conduit subsystem 102, at least one condensing unit 104, an expansion valve 114, an evaporator 116, a blower 128, and one or more thermostats 136. The working-fluid conduit subsystem 102 facilitates the movement of a working fluid (e.g., a refrigerant) through a cooling cycle such that the working fluid flows as illustrated by the dashed arrows in FIG. 1. The working fluid may be any acceptable working fluid including, but not limited to hydroflurocarbons (e.g. R-410A) or any other suitable type of refrigerant.

The condensing unit 104 includes a single-stage compressor 106, a condenser 108, and a fan 110. In some embodiments, the condensing unit 104 is an outdoor unit while other components of system 100 may be located indoors. The compressor 106 is coupled to the working-fluid conduit subsystem 102 and compresses (i.e., increases the pressure of) the working fluid. The compressor 106 is in signal communication with the controller 142 using wired and/or wireless connection. The controller 142 provides commands and/or signals to control operation of the compressor 106 and/or receive signals from the compressor 106 corresponding to a status of the compressor 106. For example, the controller 142 may provide signals to turn the compressor 106 on or off based on the operation schedule 164, which indicates when the single-stage compressor 106 turns on and off during a demand response time.

The condenser 108 is configured to facilitate movement of the working fluid through the working-fluid conduit subsystem 102. The condenser 108 is generally located downstream of the compressor 106 and is configured to remove heat from the working fluid. The fan 110 is configured to move air 112 across the condenser 108. For example, the fan 110 may be configured to blow outside air through the condenser 108 to help cool the working fluid flowing therethrough. The fan 110 may be in communication with the controller 142 (e.g., via wired and/or wireless communication) to receive control signals for turning the fan 110 on and off and/or adjusting a speed of the fan 110. The compressed, cooled working fluid flows from the condenser 108 toward the expansion valve 114. The fan 110 may be turned on and off along with the compressor 106 based on the operation schedule 164.

The expansion valve 114 is coupled to the working-fluid conduit subsystem 102 downstream of the condenser 108 and is configured to remove pressure from the working fluid. In this way, the working fluid is delivered to the evaporator 116. In general, the expansion valve 114 may be a valve such as an expansion valve or a flow control valve (e.g., a thermostatic expansion valve (TXV)) or any other suitable valve for removing pressure from the working fluid while, optionally, providing control of the rate of flow of the working fluid. The expansion valve 114 may be in communication with the controller 142 (e.g., via wired and/or wireless communication) to receive control signals for opening and/or closing associated valves and/or to provide flow measurement signals corresponding to the rate of working fluid flow through the working-fluid conduit subsystem 102.

The evaporator 116 is generally any heat exchanger configured to provide heat transfer between air flowing through (or across) the evaporator 116 (i.e., airflow 118 contacting an outer surface of one or more coils of the evaporator 116) and working fluid passing through the interior of the evaporator 116. The evaporator 116 may include one or more circuits of coils. The evaporator 116 is fluidically connected to the compressor 106, such that working fluid generally flows from the evaporator 116 to the condensing unit 104 when the HVAC system 100 is operating to provide cooling.

A portion of the HVAC system 100 is configured to move airflow 118 provided by the blower 128 across the evaporator 116 and out of the duct sub-system 122 as conditioned airflow 120. Return air 124, which may be air returning from the building, fresh air from outside, or some combination, is pulled into a return duct 126. A suction side of the blower 128 pulls the return air 124. The blower 128 discharges airflow 118 into a duct 130 such that airflow 118 crosses the evaporator 116 or heating elements (not shown) to produce conditioned airflow 120. The blower 128 is any mechanism for providing airflow 118 through the HVAC system 100. For example, the blower 128 may be a constant-speed or variable-speed circulation blower or fan. Examples of a variable-speed blower include, but are not limited to, belt-drive blowers controlled by inverters, direct-drive blowers with electronic commuted motors (ECM), or any other suitable type of blower.

The HVAC system 100 includes one or more sensors 132, 134 in signal communication with the controller 142 (e.g., via wired and/or wireless connection). Sensor 132 is positioned and configured to measure an indoor air temperature 154. Sensor 134 is positioned and configured to measure an occupancy 156 of the space serviced by the HVAC system 100. For example, an occupancy sensor 134 may be a motion sensor or the like. In some cases, occupancy 156 may be determined using known positions of occupants of the space. For example, geofencing may be used to determine occupancy based on the locations of mobile devices operated by occupants of the space. The HVAC system 100 may include one or more further sensors (not shown for conciseness), such as sensors for measuring air humidity and/or any other properties of a conditioned space (e.g. a room of the conditioned space). Sensors 132, 134 and/or any other sensors may be positioned anywhere within the conditioned space, the HVAC system 100, and/or the surrounding environment.

The thermostat 136 may be located within the conditioned space (e.g. a room or building) serviced by the HVAC system 100. The controller 142 may be separate from or integrated within the thermostat 136. The thermostat 136 is configured to allow a user to input a desired temperature or temperature setpoint 138 for the conditioned space. In some embodiments, the thermostat 136 includes a user interface and display for displaying information related to the operation and/or status of the HVAC system 100. For example, the user interface may display operational, diagnostic, and/or status messages and provide a visual interface that allows at least one of an installer, a user, a support entity, and a service provider to perform actions with respect to the HVAC system 100. For example, the user interface may provide for display of messages related to the status and/or operation of the HVAC system 100 (e.g., whether the HVAC system 100 is being operated for a demand response 140 according to an operation schedule 164 determined by the controller 142). The thermostat 136 may further be configured to monitor a historical power consumption of the HVAC system 100, which may be used to generate the home model 158, as described further below.

The thermostat 136 (and/or controller 142) may be in communication with a utility provider or other third party tasked with overseeing and/or regulating energy consumption by the HVAC systems 100. For example, a utility provider or third party may be a company or organization that distributes energy to homes and businesses. In situations in which energy demand is anticipated to exceed supply, a demand response 140 may be transmitted to HVAC system 100. As described above, the demand response 140 indicates a prescribed reduction in energy consumption (e.g., a percent reduction in energy consumption from a baseline or average value) or a maximum energy consumption (e.g., a maximum permitted energy consumption per time) during the future period of time during which a decrease in energy consumption is needed.

The controller 142 is communicatively coupled (e.g., via wired and/or wireless connection) to components of the HVAC system 100 and configured to control their operation. The controller 142 generally determines that a demand response 140 has been received and that a time period (e.g., time period 204 of FIG. 2) is upcoming during which a reduction in energy consumption by the HVAC system 100 is requested. The controller 142 then determines an operation schedule 164 indicating alternating portions of the demand response period during which the single-stage compressor 106 is to be turned off and turned on. The operation schedule 164 indicates the distribution of on and off times of single-stage compressor 106 over the time interval of the demand response 140. For example, the operation schedule 164 may indicate period of times during the demand response time during which the compressor 106 is on or off (see, e.g., alternating on times 212*a-d* and off times 210*a-d* during time period 204 of FIG. 2). In some cases, the operation schedule 164 may indicate an alternative energy-saving setpoint at which to operate the HVAC system 100 (e.g., comfort setpoint 202 of FIG. 2). For example, if the HVAC system 100 is cooling an occupied space, the setpoint 138 may be "setback" to a higher temperature for cooling mode operation.

In some embodiments, the controller 142 determines the operation schedule 164 using a home model 158. The home model 158 generally allows predicted indoor temperature(s) 160 and/or predicted occupancy 162 to be determined for the space serviced by HVAC system 100 for different possible operation scenarios 152. For instance, the home model 158 may allow different operation scenarios 152 to be proactively tested and refined to further improve occupant comfort via determination of predicted indoor temperature(s) 160 and/or predicted occupancy 162. The operation scenarios 152 are different on and off timings/schedules for the single-stage compressor 106. A predicted indoor temperature 160 may be determined (e.g., as a temperature over time, as shown for temperature 208 of FIG. 2) for each operation scenario 152.

The home model 158 may also account for a temperature forecast 150, the current indoor temperature 154, and/or an occupancy 156 of the space serviced by the HVAC system 100. For example, the home model 158 may be used to determine predicted indoor air temperature 160 as a function of one or more of outdoor air temperature (e.g., using a temperature forecast 150), compressor on/off status (e.g., from the operation scenario 152), occupancy (e.g., using a measured occupancy 156 and/or predicted occupancy 162), and a length of the demand response time period. The operation schedule 164 is the operation scenario 152 with the best performance (e.g., the operation scenario 152 for which the predicted indoor air temperature 160 is less than a threshold comfort value (e.g., temperature difference threshold 306 of FIG. 3). In some cases, the operation schedule 164 is determined as the operation scenario 152 with a predicted indoor air temperature 160 that is less than the threshold comfort value (e.g., temperature difference threshold 306 of FIG. 3) and with an energy consumption that is less than a predefined energy consumption (e.g., energy consumption threshold 308 of FIG. 3).

The home model 158 may be determined, for example, based at least in part on historical power consumption of the HVAC system 100 and historical indoor temperatures achieved by the HVAC system 100. For example, historical information about power consumption by the HVAC system 100 may be used to generate the home model 158 and subsequently determines predicted indoor temperatures 160 for a given operation scenario 152. The home model 158 may provide predicted indoor temperature 160 and/or predicted occupancy 162 as a function of run time (e.g., as indicated in operation schedule 164). One or more rounds of iteration may be used to test and/or adjust the operation scenarios 152 to determine the operation schedule 164 that maintains the predicted indoor temperature(s) 160 in a target range (see, e.g., the maintenance of temperature 208 below the comfort temperature value/setpoint 202 using operation schedule 164 and thresholds 306, 308 of FIG. 3). Examples of home models 158 and their development are described in U.S. Pat. No. 10,612,804, entitled "Operating an HVAC system to reach target temperature efficiently"; U.S. Pat. No. 10,612,808, entitled "Operating an HVAC system based on predicted indoor air temperature"; U.S. Pat. No. 10,830,474, entitled "Systems and methods of predicting energy usage"; and U.S. Pat. No. 11,067,305, entitled "Method and system for heating auto-setback", each of which is incorporated herein in its entirety.

Once the operation schedule 164 is determined, controller 142 causes the compressor 106 to operate according to the operation schedule 164. For example, the controller 142 may send signals at the start time of the demand response causing the compressor 106 to turn on and off according to the operation schedule 164. During the demand response time 204, the controller 142 may override operation according to the temperature setpoint 138, such that the HVAC system 100 is not operated according to the temperature setpoint 138 during at least a portion of the demand response time period. Instead, the controller 142 may give preference to turning on and off the compressor 106 according to the operation schedule 164

In some cases, the controller 142, while operating the compressor 106 according to the operation schedule 164, may determine that the indoor air temperature 154 becomes greater than a predefined maximum temperature (e.g., the comfort temperature setpoint 202 of FIG. 2) and increase cooling to bring the indoor air temperature 154 below this level. For example, after determining that the indoor air temperature 154 is greater than the predefined maximum temperature, the controller 142 may cause the single-stage compressor 106 to turn on at least until the indoor air temperature 154 becomes less than the predefined maximum temperature. In this way, the demand response 140 may be briefly paused to ensure that the space remains comfortable for occupants.

In some embodiments, the operation schedule 164 may be adjusted based at least in part on occupancy 156 of the space cooled by the HVAC system 100 and or a predicted occupancy 162 determined by the home model 158. Occupancies 156, 162 may be "occupied" if one or more people are in the space (or predicted to be in the space) or "unoccupied" if no one is in the space (or no one is predicted to be in the space). An occupancy sensor 134 may be used to determine the occupancy 156. Historical values of the occupancy 156 may be used by the home model 158 to determine the predicted occupancy 162, which may indicate that a space is likely to be occupied during certain portions of the day and unoccupied during other portions of the day. If the space serviced by the HVAC system 100 becomes unoccupied during the demand response time or is predicted to be unoccupied during the demand response time, the operation schedule 164 may be adjusted to cause compressor 106 to shut off at least when the serviced space is unoccupied.

The controller 142 includes a processor 144, memory 146, and input/output (I/O) interface 148. The processor 144 comprises one or more processors operably coupled to the memory 146. The processor 144 is any electronic circuitry including, but not limited to, state machines, one or more central processing unit (CPU) chips, logic units, cores (e.g. a multi-core processor), field-programmable gate array (FPGAs), application specific integrated circuits (ASICs), or digital signal processors (DSPs) that communicatively couples to memory 146 and controls the operation of HVAC system 100. The processor 144 may be a programmable logic device, a microcontroller, a microprocessor, or any suitable combination of the preceding. The processor 144 is communicatively coupled to and in signal communication with the memory 146. The one or more processors are configured to process data and may be implemented in hardware or software. For example, the processor 144 may be 8-bit, 16-bit, 32-bit, 64-bit or of any other suitable architecture. The processor 144 may include an arithmetic logic unit (ALU) for performing arithmetic and logic operations, processor registers that supply operands to the ALU and store the results of ALU operations, and a control unit that fetches instructions from memory 146 and executes them by directing the coordinated operations of the ALU, registers, and other components. The processor may include other hardware and software that operates to process information, control the HVAC system 100, and perform any of the functions described herein (e.g., with respect to FIGS. 1-4). The processor 144 is not limited to a single processing device and may encompass multiple processing devices.

The memory 146 comprises one or more disks, tape drives, or solid-state drives, and may be used as an over-flow data storage device, to store programs when such programs are selected for execution, and to store instructions and data that are read during program execution. The memory 146 may be volatile or non-volatile and may comprise ROM, RAM, ternary content-addressable memory (TCAM), dynamic random-access memory (DRAM), and static random-access memory (SRAM). The memory 146 is operable to store any suitable set of instructions, logic, rules, and/or code for executing the functions described in this disclosure with respect to FIGS. 1-4. The memory 146 may store the temperature forecast 150, operation scenarios 152, indoor temperatures 154, occupancies 156, the home model 158, predicted indoor temperatures 160, predicted occupancies 162, and operation schedules 164.

The I/O interface 148 is configured to communicate data and signals with other devices. For example, the I/O interface 148 may be configured to communicate electrical signals with the other components of the HVAC systems 100. The I/O interface 148 may send signals that cause the operation schedule 164 to be implemented by the compressor 106. The I/O interface 148 may use any suitable type communication protocol. The I/O interface 148 may comprise ports and/or terminals for establishing signal communications between the controller 142 and other devices. The I/O interface 148 may be configured to enable wired and/or wireless communications.

Connections between various components of the HVAC system 100 and between components of system 100 may be wired or wireless. For example, conventional cable and contacts may be used to couple the thermostat 136 to the controller 142 and various components of the HVAC system 100, including, the compressor 106, the expansion valve 114, the blower 128, and/or sensor(s) 132, 134. In some embodiments, a wireless connection is employed to provide at least some of the connections between components of the HVAC system 100. In some embodiments, a data bus couples various components of the HVAC system 100 together such that data is communicated there between. In a typical embodiment, the data bus may include, for example, any combination of hardware, software embedded in a computer readable medium, or encoded logic incorporated in hardware or otherwise stored (e.g., firmware) to couple components of HVAC system 100 to each other.

As an example and not by way of limitation, the data bus may include an Accelerated Graphics Port (AGP) or other graphics bus, a Controller Area Network (CAN) bus, a front-side bus (FSB), a HYPERTRANSPORT (HT) interconnect, an INFINIBAND interconnect, a low-pin-count (LPC) bus, a memory bus, a Micro Channel Architecture (MCA) bus, a Peripheral Component Interconnect (PCI) bus, a PCI-Express (PCI-X) bus, a serial advanced technology attachment (SATA) bus, a Video Electronics Standards Association local (VLB) bus, or any other suitable bus or a combination of two or more of these. In various embodiments, the data bus may include any number, type, or configuration of data buses, where appropriate. In certain embodiments, one or more data buses (which may each include an address bus and a data bus) may couple the controller 142 to other components of the HVAC system 100.

In an example operation of the system 100, the compressor 106 of the HVAC system 100 is initially turned on and allowed to facilitate cooling of the space based on the temperature setpoint 138. A demand response 140 is then received indicating that a decrease in energy consumption is needed during an upcoming period of time. An operation schedule 164 is then determined for turning the compressor 106 on and off during the demand response time of the demand response 140, and the compressor 106 is operated according to the operation schedule 164.

Figure 2:
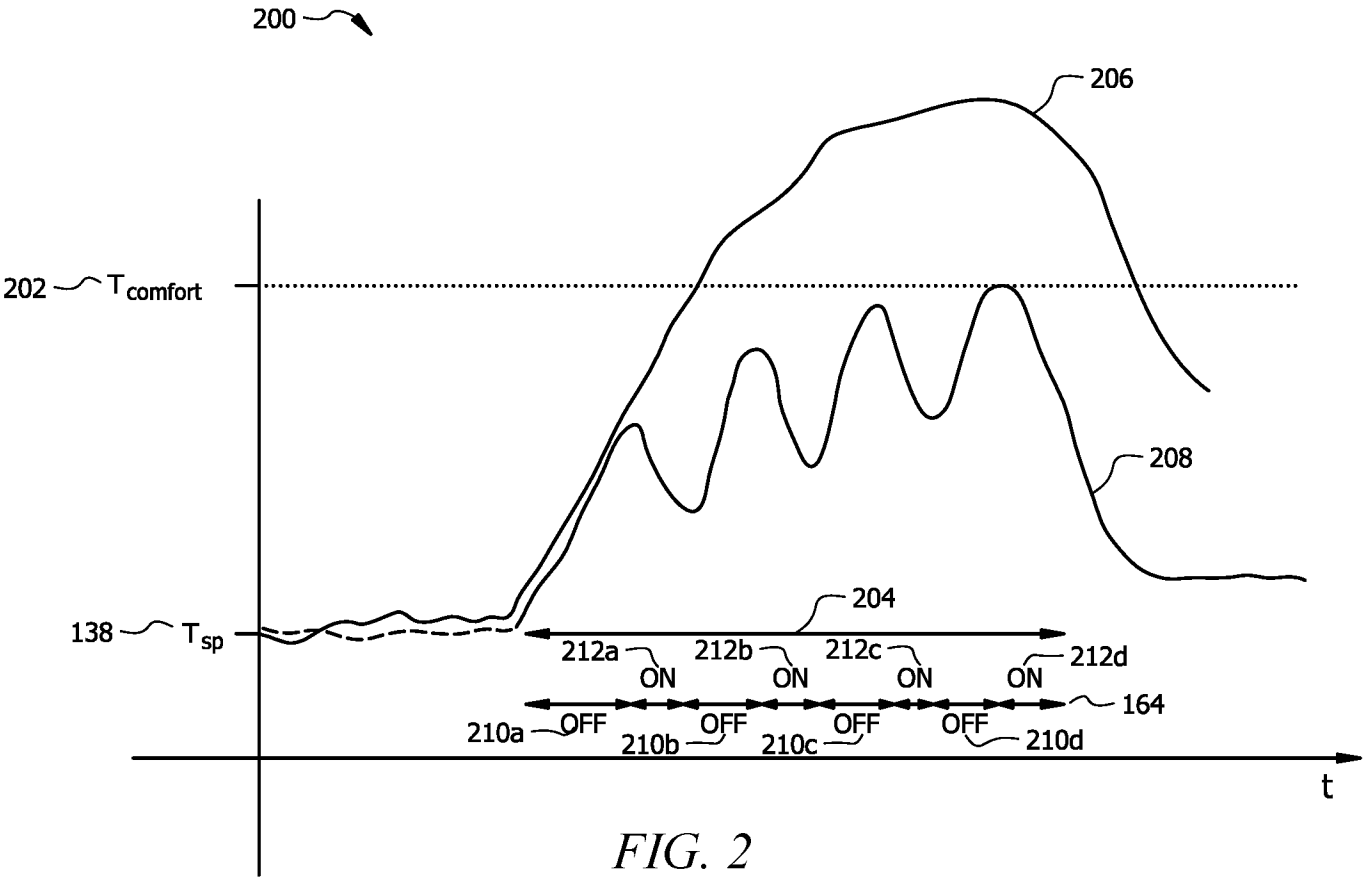
FIG. 2 is a plot illustrating example indoor temperature achieved using the new operation schedule-based approach of this disclosure compared to a temperature achieved using a conventional control strategy.

FIG. 2 shows a plot 200 illustrating an example temperature 208 that may be achieved during a demand response 140 using the improved operation schedule 164 compared to a temperature 206 achieved using a conventional approach.

The example operation schedule 164 designates alternating off times 210*a-d* and on times 212*a-d* for the compressor 106 during the time period 204 of the demand response 140.

In the conventional approach, an increased comfort setpoint 202 is used during time period 204, such that the temperature 206 increases from the initial setpoint 138 until it exceeds the comfort setpoint 202 and the compressor 106 needs to turn on for a relatively long period of time to bring the temperature back below the comfort setpoint 202. In the example of FIG. 2, temperature 206 never reaches the comfortable range below comfort setpoint 202 during the demand response time 204, such that the space is uncomfortably warm during the majority of the demand response time 204.

In the new approach of this disclosure using the operation schedule 164, the temperature 208 increases a relatively small amount during each off time 210*a-d* and decreases during each on time 212*a-d* when cooling is provided to the space. In this way, temperature 208 is maintained in a more comfortable range while still satisfying energy consumption requirements of the demand response 140.

Figure 3:
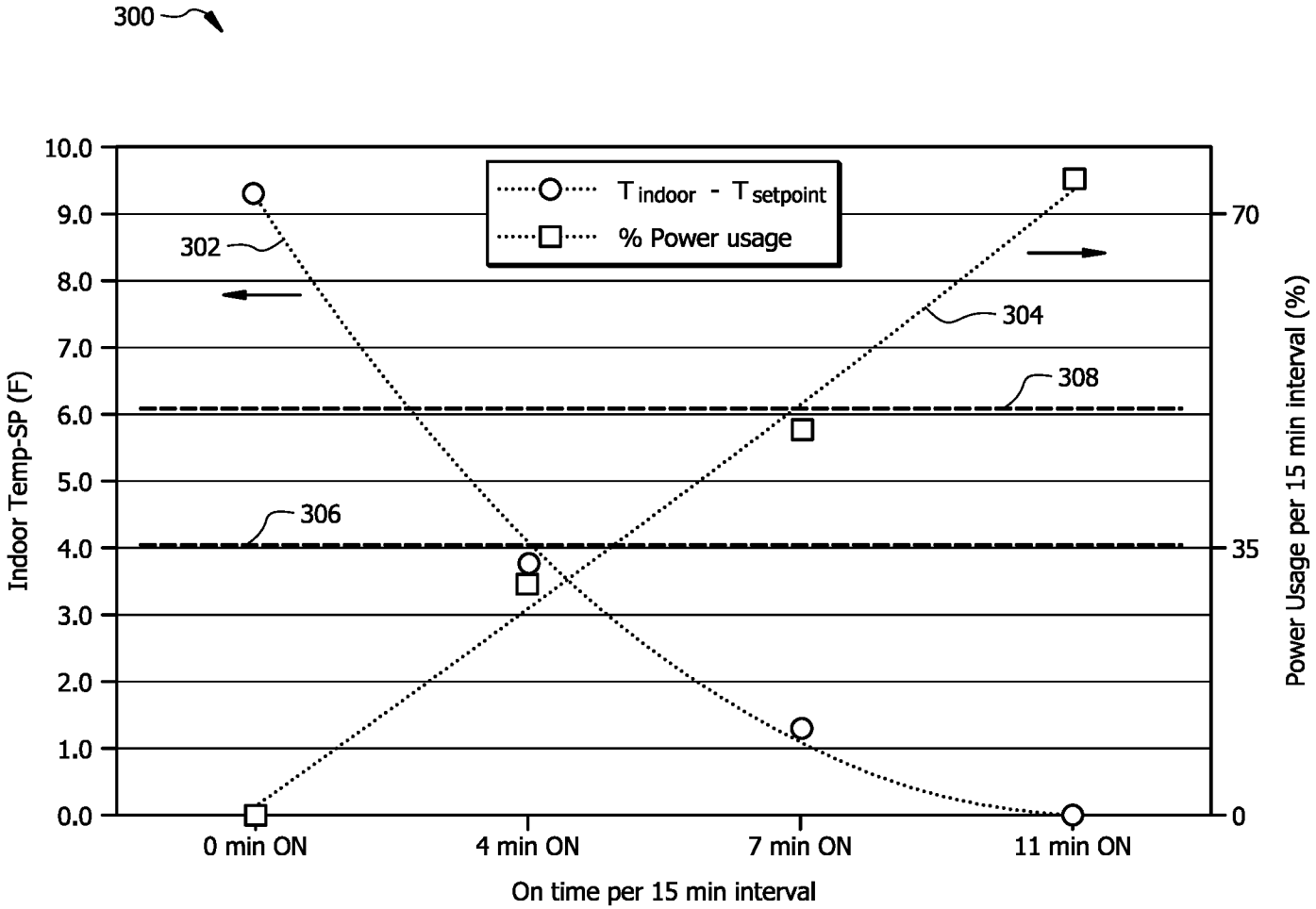
FIG. 3 is a plot illustrating the indoor temperature and power consumption achieved using different compressor operating or on times.

FIG. 3 is a plot 300 illustrating how the temperature difference 302 between the indoor temperature 154 and the original setpoint 138 varies with the on time of the compressor 106 during each fifteen-minute period of the demand response time 204 of FIG. 2. As the on time increases (from zero minutes per fifteen-minute interval to eleven minutes per fifteen-minute interval), the temperature difference 302 decreases. A decreased temperature difference 302 corresponds to improved comfort in the space serviced by the HVAC system 100. At on times of four minutes and greater, the temperature difference 302 is less than a comfort threshold value 306 corresponding to adequate comfort in the space.

Plot 300 of FIG. 3 also shows the percentage power usage 304 of the HVAC system 100 at different on times. A percentage power usage 304 of 100% corresponds to the scenario in which the compressor 106 is turned on for the entire fifteen-minute interval. The percentage power usage 304 increases with the length of the on time. At on times of seven minutes and less, the percentage power usage 304 is less than a threshold value 308 corresponding to a maximum power usage allowed for the demand response 140. Accordingly, on times of four minutes and seven minutes both satisfy the energy-saving requirements of the demand response 140 (i.e., by keeping percentage power usage 304 below threshold 308) and maintain comfort in the space (e.g., by maintaining the temperature difference 302 below threshold 306). As such, an operation schedule 164 may be determined based on the plot 300 in which the on times 212*a-d* are between about four minutes and seven minutes of each fifteen-minute interval of the demand response time 204.

Example Method of Operation

Figure 4:
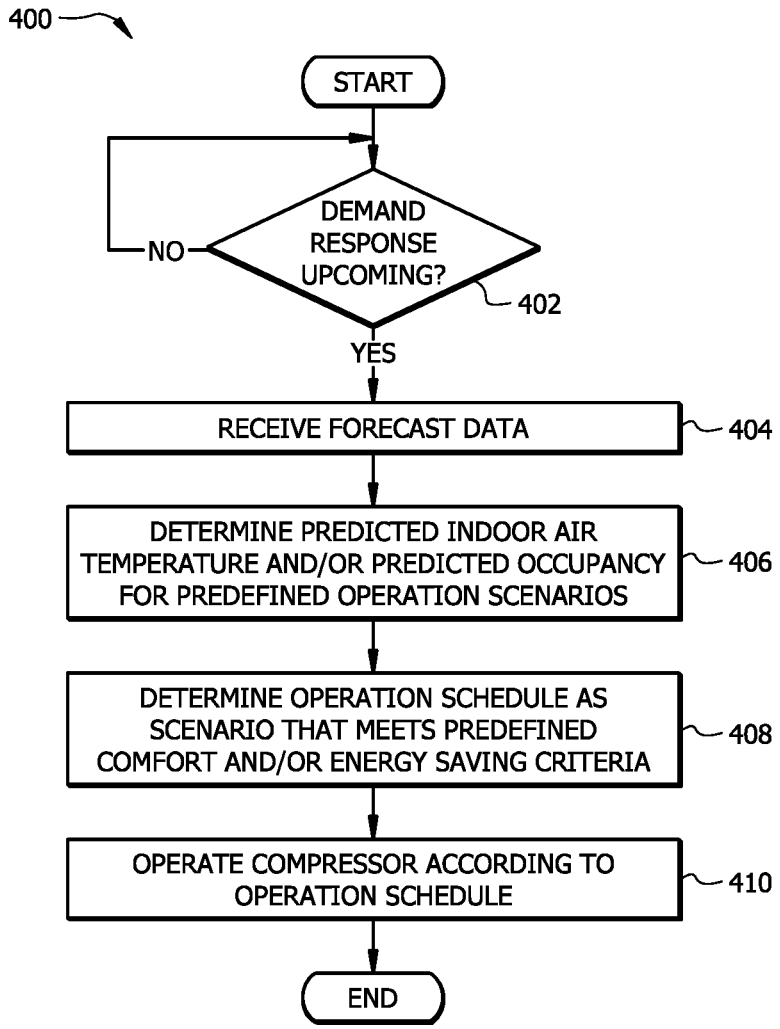
FIG. 4 is a flowchart of an example method of operating the system of FIG. 1.

FIG. 4 is a flowchart of an example method 400 of operating the system of FIG. 1. Steps of method 400 may be implemented using the processor 144, memory 146, and I/O interface 148 of the controller 142. In some cases, one or more steps may be performed by other components of the system 100 (e.g., by the thermostat 136). Method 400 may begin at step 402 where it is determined whether the start time of a demand response 140 is upcoming. If a demand response time (e.g., time 204 of FIG. 2) is upcoming, the controller 142 proceeds to step 404. Otherwise, the controller 142 waits until a demand response 140 is received indicating an upcoming demand response time.

At step 404, the controller 142 receives temperature forecast 150. The temperature forecast 150 may include predicted future outdoor air temperatures for the location in which the HVAC system 100 is operated. The temperature forecast 150 may be obtained from a weather forecast for the location of the HVAC system 100.

At step 406, the controller 142 determines predicted indoor air temperature and/or predicted occupancy for one or more operation scenarios 152. For example, the home model 158 of FIG. 1 may be used to determine values of the predicted indoor air temperature 160 over time for the predicted outdoor air temperatures indicated by the temperature forecast 150 when the compressor 106 is turned on and off according to the operation scenarios 152.

At step 408, the controller 142 determines the operation schedule 164 based on information from step 406. For example, the determined operation schedule 164 may be the operation scenario 152 for which the predicted indoor air temperature 160 is less than a comfort threshold value and the energy consumption is less than a predefined energy consumption threshold. For instance, referring to the example of FIG. 3, the determined operation schedule 164 may have an on time that satisfies both temperature difference threshold 306 and energy consumption threshold 308.

At step 410, the controller 142 operates the compressor 106 according to the operation schedule 164 from step 408. The controller 142 causes the compressor 106 to turn off and on during the different periods of time determined at step 408.

Modifications, additions, or omissions may be made to method 400 depicted in FIG. 4. Method 400 may include more, fewer, or other steps. For example, steps may be performed in parallel or in any suitable order. While at times discussed as the controller 142 performing the steps, any suitable components (e.g., thermostat 136) of the system 100 may perform one or more steps of the method 400.

While several embodiments have been provided in the present disclosure, it should be understood that the disclosed systems and methods might be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted, or not implemented.

In addition, techniques, systems, subsystems, and methods described and illustrated in the various embodiments as discrete or separate may be combined or integrated with other systems, modules, techniques, or methods without departing from the scope of the present disclosure. Other items shown or discussed as coupled or directly coupled or communicating with each other may be indirectly coupled or communicating through some interface, device, or intermediate component whether electrically, mechanically, or otherwise. Other examples of changes, substitutions, and alterations are ascertainable by one skilled in the art and could be made without departing from the spirit and scope disclosed herein.

To aid the Patent Office, and any readers of any patent issued on this application in interpreting the claims appended hereto, applicants note that they do not intend any of the appended claims to invoke 35 U.S.C. § 112(f) as it exists on the date of filing hereof unless the words "means for" or "step for" are explicitly used in the particular claim.

What is claimed is:

1. A heating, ventilation, and air conditioning (HVAC) system configured to regulate a temperature of a space, the HVAC system comprising:

a single-stage compressor configured to compress a refrigerant used to cool air provided to the space;

a controller communicatively coupled to the single-stage compressor, the controller configured to:

determine that a demand response time period is starting at a start time, wherein the demand response time period is a future period of time during which a reduction in energy consumption by the HVAC system is requested;

after determining that the demand response time period is starting at the start time, determine an operation schedule indicating alternating portions of the demand response period during which the single-stage compressor is to be turned off and turned on; and at the start time of the demand response time period, begin operating the single-stage compressor according to the determined operation schedule.

2. The HVAC system of claim 1, wherein the controller is further configured to determine the operation schedule by:

determining, using a predetermined home model, a predicted indoor air temperature for each of a set predefined operation scenarios, wherein the home model indicates predicted indoor air temperature as a function of one or more of outdoor air temperature, compressor on/off status, and a length of the demand response time period; and determining the operation schedule as the operation scenario with the predicted indoor air temperature that is less than a threshold comfort value.

3. The HVAC system of claim 2, wherein the controller is further configured to determine the operation schedule as the operation scenario with the predicted indoor air temperature that is less than the threshold comfort value and with an energy consumption that is less than a predefined energy consumption threshold value.

4. The HVAC system of claim 2, wherein the controller is further configured to determine the predicted indoor air temperature for each of the predefined operation scenarios using information from an outdoor temperature forecast.

5. The HVAC system of claim 2, wherein the controller is further configured to:

determine a predicted occupancy of the space during the demand response time period; and determine that the single-stage compressor is turned off at least during portions of the demand response time period that the space is predicted to be unoccupied based on the predicted occupancy.

6. The HVAC system of claim 1, wherein the controller is further configured to override operation according to a temperature setpoint during at least a portion of the demand response time period.

7. The HVAC system of claim 1, wherein the controller is further configured to, while the single-stage compressor is operating according to the operation schedule:

determine that an indoor air temperature is greater than a predefined maximum temperature; and after determining that the indoor air temperature is greater than the predefined maximum temperature, cause the single-stage compressor to turn on at least until the indoor air temperature is less than the predefined maximum temperature.

8. A method of operating a heating, ventilation, and air conditioning (HVAC) system configured to regulate a temperature of a space, the method comprising:

determining that a demand response time period is starting at a start time, wherein the demand response time period is a future period of time during which a reduction in energy consumption by the HVAC system is requested;

after determining that the demand response time period is starting at the start time, determining an operation schedule indicating alternating portions of the demand response period during which a single-stage compressor of the HVAC system is to be turned off and turned on; and at the start time of the demand response time period, operating the single-stage compressor according to the determined operation schedule.

9. The method of claim 8, further comprising determining the operation schedule by:

determining, using a predetermined home model, a predicted indoor air temperature for each of a set predefined operation scenarios, wherein the home model indicates predicted indoor air temperature as a function of one or more of outdoor air temperature, compressor on/off status, and a length of the demand response time period; and determining the operation schedule as the operation scenario with the predicted indoor air temperature that is less than a threshold comfort value.

10. The method of claim 9, further comprising determining the operation schedule as the operation scenario with the predicted indoor air temperature that is less than the threshold comfort value and with an energy consumption that is less than a predefined energy consumption threshold value.

11. The method of claim 9, further comprising determining the predicted indoor air temperature for each of the predefined operation scenarios using information from an outdoor temperature forecast.

12. The method of claim 9, further comprising:

determining a predicted occupancy of the space during the demand response time period; and determining that the single-stage compressor is turned off at least during portions of the demand response time period that the space is predicted to be unoccupied based on the predicted occupancy.

13. The method of claim 8, further comprising overriding operation according to a temperature setpoint during at least a portion of the demand response time period.

14. The method of claim 8, further comprising, while the single-stage compressor is operating according to the operation schedule:

determining that an indoor air temperature is greater than a predefined maximum temperature; and after determining that the indoor air temperature is greater than the predefined maximum temperature, causing the single-stage compressor to turn on at least until the indoor air temperature is less than the predefined maximum temperature.

15. A controller of a heating, ventilation, and air conditioning (HVAC) system, the controller comprising:

an interface communicatively coupled to a single-stage compressor configured to compress a refrigerant used to cool air provided to the space; and a processor communicatively coupled to the interface, the processor configured to:

determine that a demand response time period is starting at a start time, wherein the demand response time period is a future period of time during which a reduction in energy consumption by the HVAC system is requested;

after determining that the demand response time period is starting at the start time, determine an operation schedule indicating alternating portions of the demand response period during which the single-stage compressor is to be turned off and turned on; and at the start time of the demand response time period, begin operating the single-stage compressor according to the determined operation schedule.

16. The controller of claim 1, wherein the processor is further configured to determine the operation schedule by:

determining, using a predetermined home model, a predicted indoor air temperature for each of a set predefined operation scenarios, wherein the home model indicates predicted indoor air temperature as a function of one or more of outdoor air temperature, compressor on/off status, and a length of the demand response time period; and determining the operation schedule as the operation scenario with the predicted indoor air temperature that is less than a threshold comfort value.

17. The controller of claim 16, wherein the processor is further configured to determine the operation schedule as the operation scenario with the predicted indoor air temperature that is less than the threshold comfort value and with an energy consumption that is less than a predefined energy consumption threshold value.

18. The controller of claim 16, wherein the processor is further configured to determine the predicted indoor air temperature for each of the predefined operation scenarios using information from an outdoor temperature forecast.

19. The controller of claim 16, wherein the processor is further configured to:

determine a predicted occupancy of the space during the demand response time period; and determine that the single-stage compressor is turned off at least during portions of the demand response time period that the space is predicted to be unoccupied based on the predicted occupancy.

20. The controller of claim 15, wherein the processor is further configured to, while the single-stage compressor is operating according to the operation schedule:

determine that an indoor air temperature is greater than a predefined maximum temperature; and after determining that the indoor air temperature is greater than the predefined maximum temperature, cause the single-stage compressor to turn on at least until the indoor air temperature is less than the predefined maximum temperature.

* * * * *